US006205732B1

(12) United States Patent
Rebman

(10) Patent No.: US 6,205,732 B1
(45) Date of Patent: Mar. 27, 2001

(54) SURFACE MOUNTED GRID SYSTEM

(75) Inventor: Robert J. Rebman, Winnebago County, WI (US)

(73) Assignee: Acoustic Ceiling Products, L.L.C., Neenah, WI (US)

( * ) Notice: Subject to any disclaimer, the term of this patent is extended or adjusted under 35 U.S.C. 154(b) by 0 days.

(21) Appl. No.: 09/314,559

(22) Filed: May 19, 1999

(51) Int. Cl.[7] ..... E04B 9/12; E04B 9/00

(52) U.S. Cl. ..... 52/506.07; 52/463; 52/506.06; 52/664

(58) Field of Search ..... 52/506.06, 506.07, 52/506.08, 506.09, 506.1, 512, 456, 461, 463, 464, 466, 664, 665

(56) References Cited

U.S. PATENT DOCUMENTS

| | | | |
|---|---|---|---|
| 3,000,474 | * | 9/1961 | Friedman et al. . |
| 3,263,388 | * | 8/1966 | Bogert . |
| 3,355,206 | * | 11/1967 | Valsvik . |
| 3,594,970 | | 7/1971 | MacGrath, et al. . |
| 3,844,086 | * | 10/1974 | Radtke . |
| 3,857,216 | * | 12/1974 | Sherman . |
| 4,115,970 | | 9/1978 | Weinar . |
| 4,128,978 | | 12/1978 | Beynon . |
| 4,452,021 | | 6/1984 | Anderson . |
| 4,485,605 | * | 12/1984 | LaLonde . |
| 4,586,841 | | 5/1986 | Hunter . |
| 4,718,213 | | 1/1988 | Butterfield . |
| 4,848,054 | | 7/1989 | Blitzer et al. . |
| 4,883,513 | | 11/1989 | Monson, et al. . |
| 4,893,444 | | 1/1990 | Ollinger et al. . |
| 5,044,138 | * | 9/1991 | Zaccardelli et al. . |
| 5,313,750 | | 5/1994 | Frecska et al. . |
| 5,347,783 | | 9/1994 | Frecska et al. . |
| 5,396,748 | | 3/1995 | Rogers . |
| 5,421,132 | | 6/1995 | Bischel . |
| 5,428,930 | | 7/1995 | Bagley et al. . |
| 5,495,697 | | 3/1996 | Bischel et al. . |
| 5,535,566 | | 7/1996 | Wilson et al. . |
| 5,611,185 | * | 3/1997 | Wilz . |
| 5,836,127 | | 11/1998 | Clark et al. . |

FOREIGN PATENT DOCUMENTS

| | | |
|---|---|---|
| 2520411 | 7/1983 | (FR) . |
| 52128222 | 4/1984 | (GB) . |
| 2142356 | 1/1985 | (GB) . |
| 2173227 | 10/1986 | (GB) . |

* cited by examiner

*Primary Examiner*—Robert Canfield
(74) *Attorney, Agent, or Firm*—Michael Best & Friedrich LLP

(57) ABSTRACT

A surface mounted grid system for use in association with a substructure and for supporting an array of tile panels which comprises: (a) a plurality of main runners and cross-runners adaptable arranged normal to each other. The main runner has (i) a horizontally oriented surface and spaced, non-peripheral, longitudinal side walls depending transversely therefrom and includes a plurality of spaced openings; and (ii) a downwardly depending member terminating with a horizontally disposed flange having a longitudinal marginal edge. The cross-runners have (i) a horizontally disposed flange with a transverse marginal edge and arranged in a common plane with the flange of the main runner, and (ii) an intermediate longitudinal web extending transversely from the flange and having a longitudinal projection extending beyond the transverse marginal edge. The projection is adaptable for insertion into the opening upon the perpendicular arrangement to provide for mating engagement of the longitudinal marginal edge of the main runner with the transverse marginal edge of the cross-runner, thereby supporting the cross-runner and preventing undesired disengagement therebetween, and the flange of the main runner and the flange of the cross-runner being disposed to support tile panels in a common plane.

10 Claims, 3 Drawing Sheets

10
14
16
18
12
20
22

16
64
66
60
61
62

34
24
50
36
37
30
28
56
32

66
62
24
50
32
26

24
60
62
64
50
40
60
62
64
50

34
50
32
50
56
56
28
56

44
45
40
42
46
26

66
26
40
24
62
64
32
64
42
50
62
60
66
60

28
24
26
12

SURFACE MOUNTED GRID SYSTEM

FIELD OF THE INVENTION

This invention relates to a surface mounted grid system for a ceiling and the like. In its more specific aspect, this invention relates to a surface mounted grid system adaptable for use in association with a substructure such as a ceiling, roof, or wall, to support an array of panels such as acoustical tile panels.

BACKGROUND AND PRIOR ART

Ceiling grid systems comprised of horizontal runners, for supporting tile panels such as acoustical ceiling tile are used extensively in both new and remodeled building and room structures. The grid typically consists of main runners and cross-tees, having lateral supporting shoulders or flanges, and are arranged perpendicular to each other to form a rectangular pattern. The runners most typically are suspended by a wire connected to an existing ceiling or exposed framing member, and the cross-tees are attached or mounted to the runners in a perpendicular direction to form a rectangular pattern. Less frequently, the grid is installed without suspension by nailing the runners directly to the ceiling or framing members, and then connecting the cross-tees normal to the runners. After the grid is installed, the tile panels are eased into place onto the supporting flanges of the runners and cross-tees. A grid system offers many advantages such as increasing a room's energy efficiency, improving a room's acoustics, and enhancing the aesthetic value of a room, and a suspended system is further advantageous in that it provides means for lowering a ceiling, and/or allowing for the installation of electrical fixtures, pipes and duct work.

Ceiling grid systems are relatively inexpensive and easy to install as compared to a plaster ceiling. As a consequence, there is a continuing need to improve on the design and integrity of the grid system, particularly in light of the fact that many systems are installed in commercial buildings requiring years of service, or installed by the do-it-yourself home owner. What is available or disclosed in the prior art exhibit certain deficiencies or disadvantages, however, particularly with respect to a surface mounted system. For example, U.S. Pat. No. 3,263,388 to Bogert discloses a ceiling tile installation which includes an anchor 14 having a base flange 14*a* for nailing to a wood joist, and a bifurcated web 14*b* with internal teeth 18 extending transversely from the flange. The shaped runner 15 has a transverse web 15*b* with teeth 18 on the outer surface which interlock with the teeth of the bifurcated web when the runner is engaged with the anchor, and the base flange 15*a* supports the tile panel along its marginal edge.

There is disclosed in U.S. Pat. No. 3,857,216 to Sherman a panel suspension system comprising a top element 14*a* of a T configuration having a web 20 with outwardly disposed teeth 30, and a bottom element 14*b* of a T configuration but with a bifurcated web 32 having internal teeth 33 and adapted to receive, and frictionally retain, the web of top element 14*a*. In practice, the top element is fastened to a joist 25, a ceiling panel 15 is then placed against the top element, and the bottom element is pushed upwardly so that the teeth of the top and bottom webs matingly engage and hold the ceiling panel in place.

U.S. Pat. No. 4,067,155 to Ruff provides a sealed joint between panels. The system disclosed is for joining and adhering a pair of abutting panels to a rigid substrate to provide a seal against thermal and moisture transfer. The system includes mating T members comprising receptacle 16 having a base 20 for nailing to a substrate, and insert 18 having a resilient, deformable cap 60. When the members are engaged and frictionally retained by reason of the mating teeth 32 and 64, a force on the resilient, deformable cap provides an upward force against the interlocking teeth thereby providing a secure engagement not susceptible to removal or loosening.

A weather tight seal for a roof or wall is disclosed in U.S. Pat. No. 3,339,329. According to the teachings of this patent, the panel cover includes an inverted channel member 12, which is nailed to the roof, and has a centrally located cleft 30 with a constriction 34. A locking bar 42 having a T-like configuration and terminating with a wedge 46 is inserted through a sealing compound 36 and into the cleft where it is engaged by the constriction.

The prior art, however, exhibits certain deficiencies or disadvantages. For example, a suspended grid system is not always necessary, and is generally more time consuming and has added expense as compared to a surface mounted system. Also, known systems typically require mounting a section only of the runners, then inserting the panel, and then mounting the remainder of the runners, whereas it generally would be simpler to first install completely the grid and then insert the panels.

The prior art discloses positioning a new ceiling over an existing ceiling in U.S. Pat. No. 4,769,965 and in U.S. Pat. No. 5,611,185. In the '965 patent, a Z-shaped runner 2 is fastened to the existing ceiling and ceiling boards rest on the horizontal flanges 8. A cross-runner 18 rests on the horizontal flanges, and an indentation and groove lock the cross-runner in position. Patent No. '185, which is assigned to the same assignees of the subject application and is incorporated herein by reference, provides a surface mounted grid system comprising a plurality of spaced main runners 14 and crossed runners 16 arranged normal to each other. The main runners comprise a top member 24 having a fascia 28 with a plurality of spaced notches 38 and a downwardly depending bottom member 26 having a horizontal flange 40. The cross-runners have horizontal flanges 40 arranged in a common plane with the flanges of the main runners, which support the tile panels. The cross-runners include connecting means for insertion in the notches upon assembly of the runners.

This invention has, therefore, as its purpose to provide an improved grid system which can be surface mounted in association with a substructure or framing member, such as a joist, and is relatively easy to install.

It is another object of the invention to provide a grid system which results in little or no loss of ceiling height, and can be installed to an existing ceiling without any need for demolition of the existing ceiling.

It is another object of the invention to provide a grid system of the above character made from a plurality of interlocking and connecting elements which can be readily assembled to yield a grid of any desired dimension.

It is yet another object of the invention to provide a grid system of the above character which provides for immediate and easy adjustment in order to accommodate tile panels of different thicknesses.

This invention has as still another object to provide a grid system of generally modular construction which lends itself to complete fabrication from regularly employed materials, particularly plastics.

In yet another object of the invention to provide a grid system which, after installation, provides easy access for opening a grid at any desired location such as the need to replace a soiled or damaged tile panel.

Still another object of the invention is to provide a ceiling grid system installed by a process which is relatively simple and less time consuming than usually required for a typical suspended grid system.

SUMMARY OF THE INVENTION

In accordance with my invention, there is provided a surface mounted grid system for supporting an array of tile panels and adaptable for use in association with a substructure, such as a wood joist or other suitable framing member, or an existing ceiling. Although the grid system is described herein with particular emphasis on a system to support ceiling tile, it should be understood that the grid system can support any panel other than ceiling panels, or can be used on any substructure such as a wall. Broadly, the grid system of my invention comprises a plurality of spaced, horizontally disposed main runners and cross-runners, which are arranged substantially perpendicular to each other to form a rectangular pattern. The main runners, which are adaptable for attachment to the substructure, comprises a top member or crosspiece having a horizontally oriented surface or fascia and a downwardly depending member of T-configuration terminating with a horizontally disposed flange. Depending downwardly from or transversely to the horizontally oriented surface of the crosspiece are non-peripheral, longitudinal side walls, which are spaced apart, and each of the side walls has a plurality of spaced openings or holes, and the holes in one of the side walls are aligned with the holes in the other side wall. The cross-runners are of a conventional T-configuration and have a horizontally oriented flange, and an intermediate longitudinal web extending transversely from the flange. The cross-runners are arranged substantially perpendicular to the main runners so that the horizontally oriented flange of the cross-runners are disposed in a common plane with the flange of the main to runners. Thus, the transverse terminal edge of the flange of the cross-runner abuts the longitudinal terminal edge of the flange of the main runner. In this manner, the flanges of the main runners and the flanges of the cross-runners support the tile panels in a common plane.

The crosspiece of the main runners may be attached to the substructure as with screws or staples at spaced intervals. The longitudinal web of the cross-runners is provided with connecting means comprising a longitudinal projection extending beyond the transverse marginal edge of the cross-runner for insertion into or through the openings or holes in the walls of the crosspiece. Thus, upon the perpendicular arrangement of the runners, the longitudinal marginal edge of the main runner is disposed for mating engagement with the transverse marginal edge of the cross-runner, and this connecting means thereby supports the cross-runner and prevents undesired disengagement between main runner and the cross-runner.

In a more specific embodiment, the main runner is comprised of a top member and a bottom member which upon engagement, form or define a groove, recess or rabbet for seating the marginal edge portion of a panel and holding it in place, as explained below in more detail. The top members of the main runners have (i) a substantially flat fascia adaptable for mounting or attachment to the substructure, and (ii) spaced, non-peripheral, longitudinal flexible side walls which extend transversely from the fascia to provide a flexural channel opening. The inside channel walls of the top member have at least one inwardly directed flange or detent. The bottom members of the main runners are of substantially T-configuration in transverse cross-section having (i) a flange and (ii) an intermediate longitudinal web extending transversely there-from and provided with at least one projection, boss or barb. The channel opening of the top member is adapted to receive the longitudinal web of the lower member, the internal flange or detent of the channel walls providing a co-operable interlocking element with the projection of the web of the bottom member to prevent undesired disengagement therebetween. In this manner, the bottom member, depending from the top member, is retained in engagement with the top member.

The side walls or channel walls of the top member of the main runner is provided with a plurality of spaced openings or holes adaptable to receive the tab projectin longitudinally from the web of the cross-runner when the two runners are arranged perpendicular to each other. It will be observed that the horizontally oriented flanges of the main runner and cross-runner define a groove, recess or rabbet adaptable to receive and hold in place a tile panel. Further, the depth of this groove is adjustable and can therefore accommodate panels of in varying thicknesses. Upon engagement of the two members, the transverse marginal edge of the flange of the cross-runner abuts the longitudinal marginal edge of the flange of the lower member of the main runner.

In accordance with a modified embodiment of my invention, the channel walls or side walls depending downwardly from the fascia of the top member of the main runner are disposed inwardly from the longitudinal marginal edge of the fascia, and the channel walls are flanked on each side by second side walls or flanges depending downwardly so as to be on opposite sides of the channel walls. The second side walls are provided with a plurality of spaced openings or holes adaptable to receive the longitudinal projection of the web of the cross-runner when the two runners are arranged perpendicular to each other. Upon assembly, the cross runners are arranged normal to the main runners so as to insert the projections of the cross-runner into the holes of the transverse, outer walls bringing the edges of the two runners into mating engagement, thereby securing the grid system.

DETAILED DESCRIPTION OF THE INVENTION

Figures 1, 2, 3, 4:
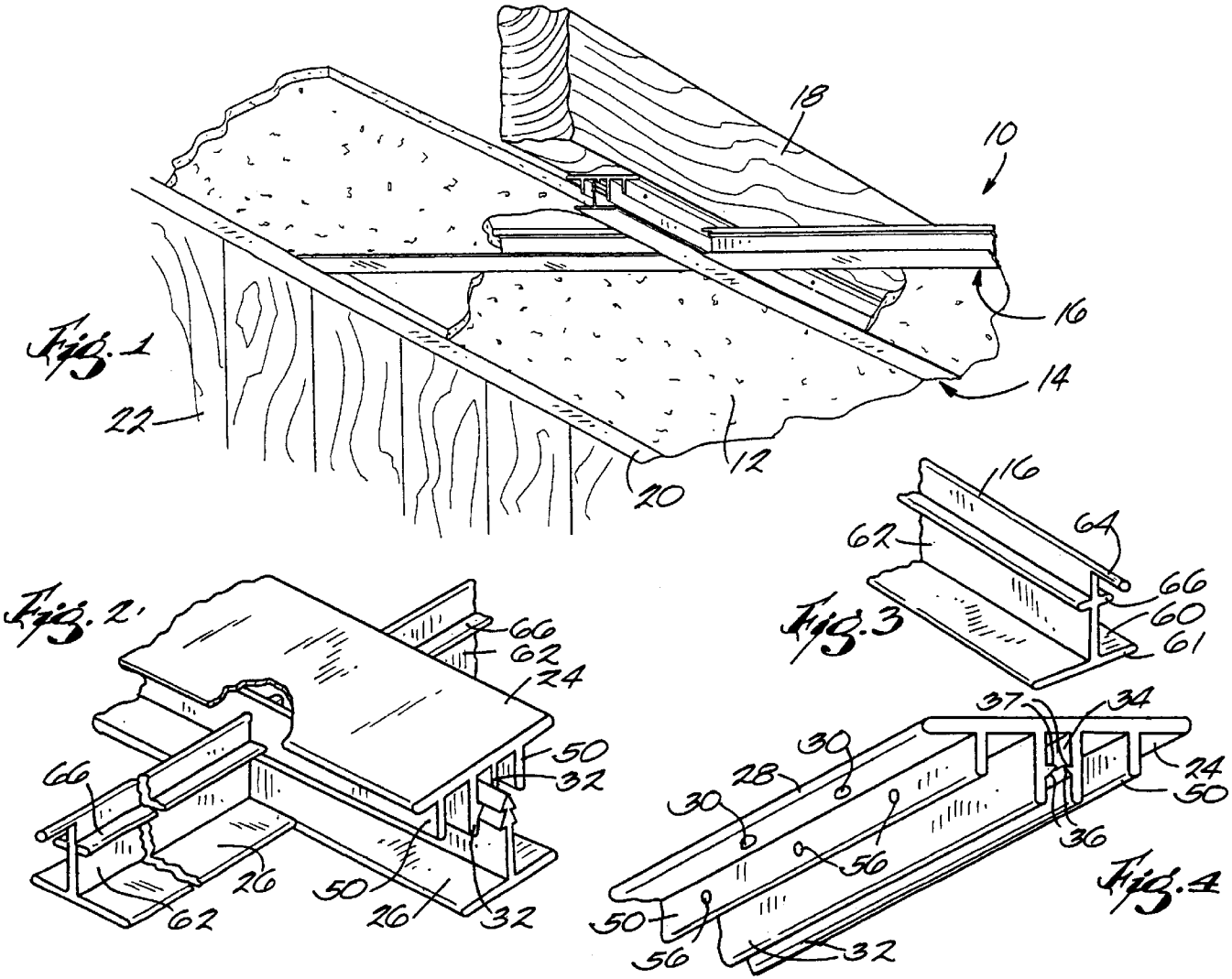
FIG. 1 is a perspective view of a ceiling grid system, looking upward, of the present invention.
FIG. 2 is a perspective view, partly in fragmentary, showing in more detail the main runner and cross-runner after assembly.
FIG. 3 is a perspective of a cross-runner of the present invention shown in FIG. 2.
FIG. 4 is a perspective view of the top member or the main runner shown in FIG. 2.

Referring to the drawings, wherein the same reference numerals refer to similar parts throughout the several views, there is shown in FIG. 1 a grid system of the present invention, indicated generally by the numeral 10, installed on a ceiling and supporting ceiling tile 12. In accordance with one embodiment of the invention, the grid system 10 comprises a plurality of main runners, indicated generally at 14, and cross-runners, indicated generally at 16, disposed substantially perpendicular to the main runners. The Main runners 14 are spaced at predetermined distances in parallel rows, and the cross-runners 16 are similarly spaced in parallel rows normal to the main runners, thereby forming a rectangular grid for supporting the tiles. As shown in FIG. 1, the main runners 14 are affixed or fastened to a substructure such as the wooden joist 18, or similar framing member, by any suitable means such as nails, screws, or the like. If the grid is attached to a plaster ceiling (not shown), it is more desirable to use anchor bolts or the like. Wall angle bracket or wall molding 20 is attached to the wall 22 at or near the edges of the ceiling (in practice, the molding is attached to all the walls of the room) and at about the same height as the runners, and supports the runners and ceiling panels at the marginal edges. The wall molding may be of any conventional construction, and typically comprises a vertical backing plate and a horizontal flange. Thus, the wall molding is properly aligned, and the backing plate is attached to the wall by such means as nailing or the like. The horizontal flange supports the panels and runners.

Figures 5, 6, 7, 8, 9:
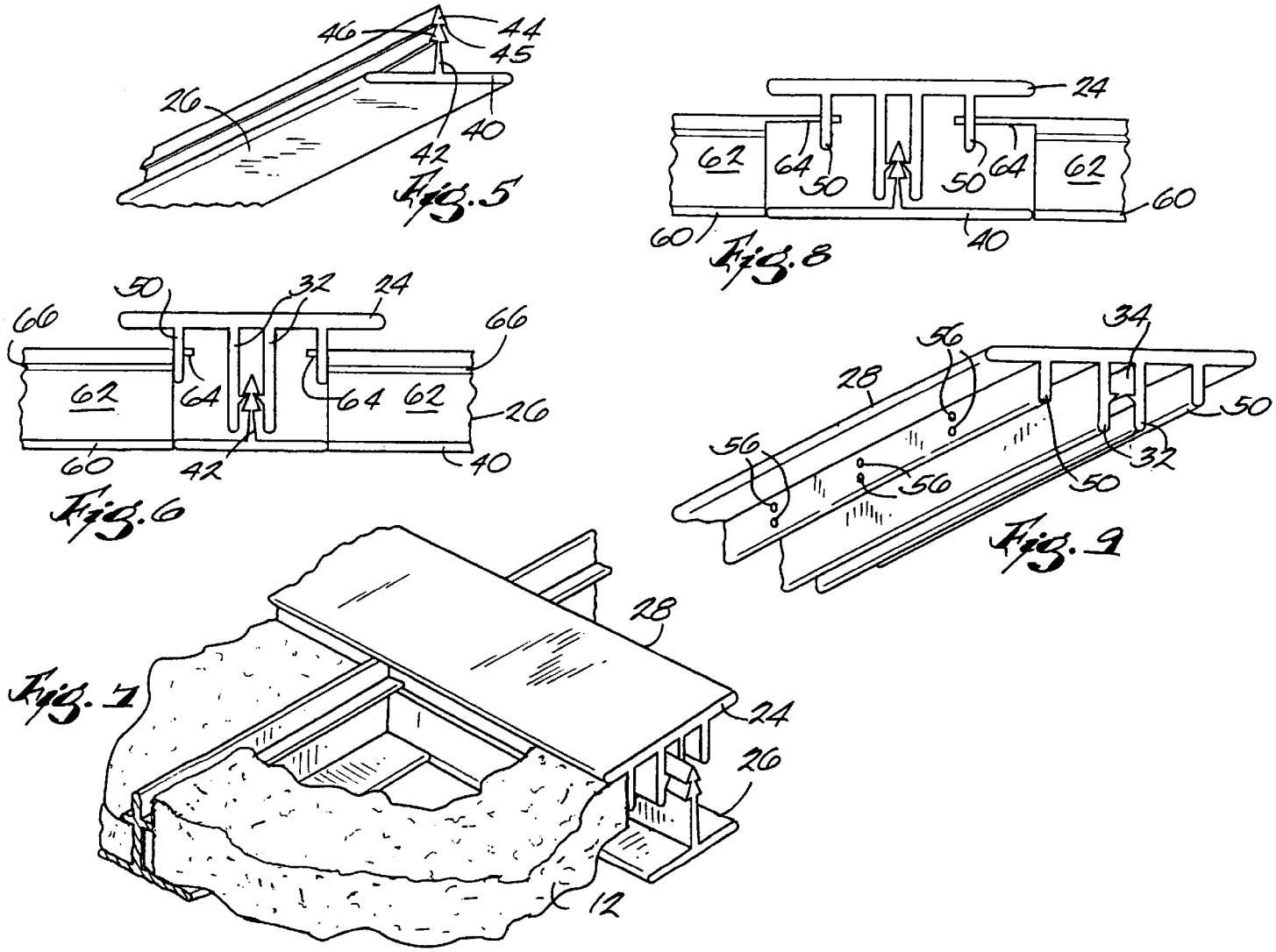
FIG. 5 is a perspective view of the bottom member or the main runner shown in FIG. 2.
FIG. 6 is an elevational end view showing the members of the main runner and the cross-runner of FIG. 2 brought into engagement.
FIG. 7 is a perspective view showing in more detail the main runner and cross-runner after assembly for supporting a ceiling tile.
FIG. 8 is an elevational end view showing an alternative embodiment of the invention with the runners assembled.
FIG. 9 is a perspective view of an alternative embodiment of the invention showing the top member of the main runner.
Figure 11:
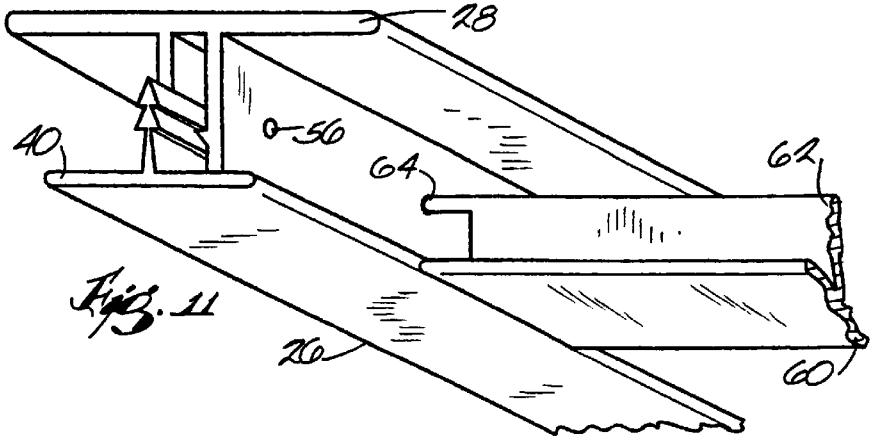
FIG. 11 is a perspective view of a modified embodiment showing the top member or the main runner with the main runner and cross-runner after assembly.
Figure 14:
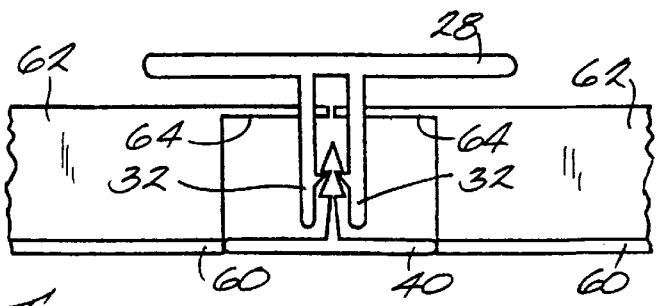
FIG. 14 is an elevational end view showing the members of the main runner and the cross-runner of FIG. 11 brought into engagement.
Figure 10:
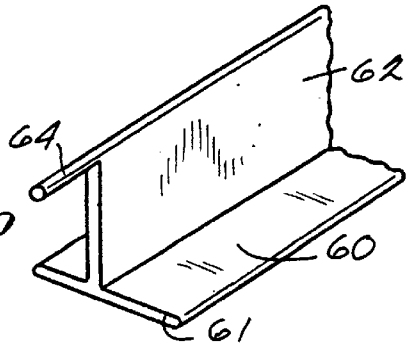
FIG. 10 is a perspective view of a cross-runner of the embodiment of FIG. 11.
Figure 12:
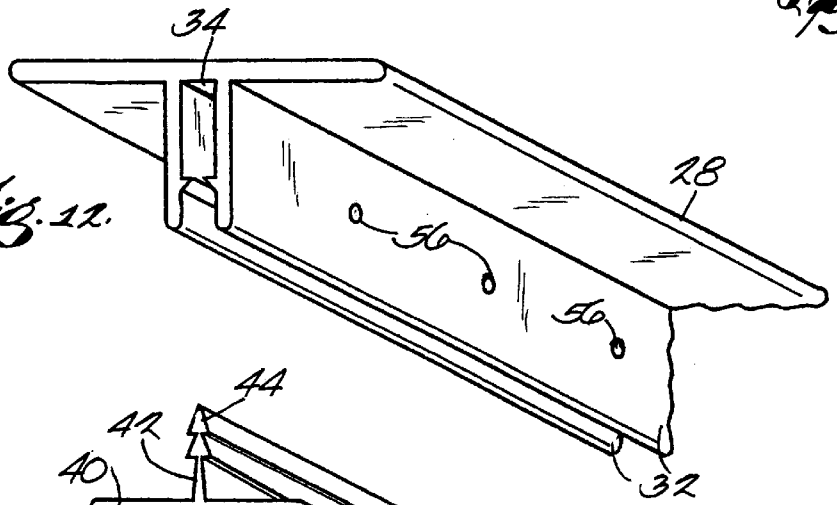
FIG. 12 is a perspective view of the top member or the main runner shown in FIG. 11.
Figure 13:
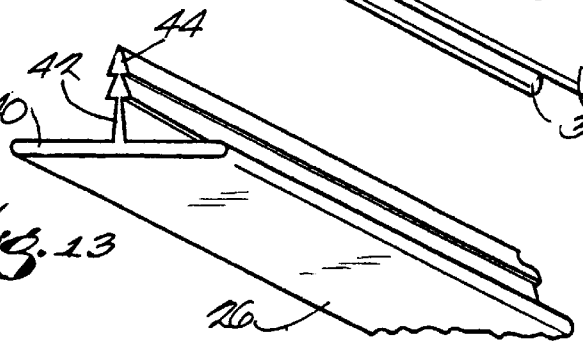
FIG. 13 is a perspective view of the bottom member or the main runner shown in FIG. 11.

There is shown in FIGS. 2–7 greater details of the runners and the assembly of the members. It should be noted that the runners are typically made of plastic, or metal, which materials are well known and used for ceiling grid systems. As best seen in FIGS. 4 and 5, main runner 14 comprises a top member (e.g. crosspiece) 24 and complementary bottom member 26. Top member 24 has a substantially flat, elongated fascia or backing 28 adaptable to be affixed or mounted to the substructure, such as joist 18, such as by nailing or the like. Where desired, the fascia is prepunched with holes 30 to accommodate nails or screws. Depending downwardly from the fascia 28 are two spaced, non-peripheral side walls 32 which run about the complete longitudinal length of the fascia runner, and preferably are co-terminus therewith. The side walls are flexible, either by being formed of a flexible material, and/or being of such a gauge as to exhibit flexibility. It thus will be observed that the side walls form a longitudinal channel 34 for receiving the bottom member 26, as described below in greater detail. Preferably, the side walls 32 are parallel, but where desired the walls may converge slightly in order to provide for better retention of the lower member. Further, both side walls 32 are provided with internal flanges or detents 36 at or adjacent the terminus of the walls. The detent 36 preferably has an inwardly disposed, planar shoulder 37 which is substantially normal to the side wall, for reasons explained below.

In accordance with this embodiment of the invention, side wall or channel walls 32 are flanked on each side by a second wall or flange 50 which depends downwardly or transversely from the fascia. Thus, it will be observed that the second wall is disposed to each side of the channel walls so as to be spaced therefrom, but indented from the marginal edge or the fascia, as best seen in FIG. 4. A plurality of spaced openings or holes 56 is formed in each of the second walls, and where desired there are at least two horizontally aligned rows of holes (see FIG. 9) to allow for adjustment so as to accommodate tiles of varying thickness, as explained below in greater detail.

Bottom member 26 of main runners 14 is of substantially T-configuration in cross-section, comprising a flange 40 for supporting a tile panel and an intermediate transverse web 42 extending longitudinally therefrom. Projection, boss or barb 44 at or adjacent the outer terminus of the web 42 extends for substantially the complete longitudinal length thereof, and preferably is co-terminus therewith. (See FIG. 5) Preferably, the underside of the boss 44 has a planar shoulder 45 which is substantially normal to the web. Where desired, the web 42 may have one or more strengthening ribs 46. The top and bottom members of runners 14 are assembled substantially as shown in FIGS. 2 and 6. The fascia 28 of the top member 24 of the main runner 14 is first nailed or screwed to the substructure, e.g., ceiling joist. The bottom member 26 of the main runner 14 is then conjoined with the top member 24 by inserting the web 42 into the channel 34, and then slowly retracting the bottom member until the shoulder 45 of barb 44 seats on the shoulder 37 of flange 36. The engagement of these two members is clearly illustrated in FIG. 6. It will be observed that the tile supporting flange 40 of the bottom member 26 and the fascia 28 of the top member 24 define a groove, recess or rabbet adaptable to receive a tile panel.

The cross-runners 16, which are arranged substantially perpendicular to the main runners, comprises a horizontally disposed flange 60 having a transverse marginal edge 61, which upon assembly, the flange 40 is disposed in a common plane with the flange of the main runner. An intermediate longitudinal web 62 extends transversely from the flange 60, and includes a longitudinal projection 64 extending beyond the transverse marginal edge 61. Preferably, longitudinal shoulder 66 extends transversely from the web at about an intermediate position along the web, and the transverse marginal edge of the shoulder is co-terminus with the transverse marginal edge of the web and the flange of the cross-runner. The term "intermediate" as used herein and in the appended claims is not limited to mean in the middle, but rather includes between the extremities.

The cross-runners are installed perpendicular to the main runners by inserting the projection 64 into the hole 56. That is, the holes 56 are adaptable to receive the projection 64 when the two runners are arranged perpendicular to each other. The transverse marginal edge of flange 60 of the cross-runner 16 abuts the longitudinal marginal edge of flange 40 of the bottom member 26 of the main runner 14. Upon assembly of the members of this embodiment, the top and bottom members 24 and 26, respectively, are engaged and interlocked, as shown in FIGS. 2 and 6. Thus, the cross-runner 16 is brought into perpendicular arrangement with the main runner 14 at the holes 56 which receive the projections 64. It will be observed that the width of flange 40 or the cross-runner is substantially less than the width of fascia 28, as best seen in FIG. 6. Thus, when the members are assembled, the transverse marginal edge of the shoulder 66 of the cross-runner 16 is brought into abutment, or near abutment, with the wall 50, and the transverse marginal edge 61 of flange 60 of the bottom member 26 of the cross-runner 16 abuts the longitudinal marginal edge of flange 40 of the bottom member 26 of the main runner 14. When the assembly is complete, as shown in FIGS. 6 and 7, the tile panel 12 is eased into place. Because the grid system is characterized of high integrity, the ceiling is now secure.

Tile panels 12 are then eased into position and the bottom members of both runners may be adjusted to accommodate the thickness of the tile. It will be observed that the tile panels lay substantially in a common plane with the flanges of the main and cross-runners.

In accordance with the modified embodiment shown in FIG. 8, the width of fascia 28 and the width of flange 40 are essentially the same. Thus, upon assembly of the runners, when the projection 64 is inserted in hole 56 the transverse marginal edge 61 of the flange 60 abuts the longitudinal marginal edge of the flange 40, and no part of the cross-runner abuts the transverse wall 50.

In another embodiment of the invention, as illustrated in FIGS. 10–14, the channel walls 32 are provided with holes 56. Also, web 62 of the cross-runner is not provided with a shoulder as in the prior embodiment. When the runners are assembled, the projection 64 is inserted in hole 56 and the transverse marginal edge 61 of the flange 60 abuts the longitudinal marginal edge of the flange 40, and no part of the cross-runner abuts the transverse wall 32.

It will be observed that by reason of my invention numerous advantages are achieved with the ceiling grid system. Thus, there is provided a ceiling grid system of generally modular construction that is easy to install, that can support tile panels of varying thicknesses, and that provide a rugged and secure system. In addition, it will be observed that because the several members are snap fit, it is possible to snap and unsnap the grid system not only during installation but after the ceiling is in place, such when replacing a soiled or damaged tile. Further, it should be understood that the foregoing detailed description has been given for clearness of understanding only, and no unnecessary limitations should be understood therefrom, as modifications will be obvious to those skilled in the art.

Having described my invention and certain embodiment thereof, I claim:

1. A surface mounted grid system for use in association with a substructure and for supporting an array of tile panels which comprises: (a) a plurality of main runners and cross-runners adaptable for spaced, horizontal disposition; (b) said main runners adaptable for attachment to the substructure, and including (i) a crosspiece having a horizontally oriented surface and spaced, non-peripheral, longitudinal side walls depending transversely from said horizontally oriented surface, said side walls having a plurality of spaced openings; and (ii) a downwardly depending member terminating with a horizontally disposed flange having a longitudinal marginal edge; (c) said cross-runners arranged substantially perpendicular to said main runners, said cross-runners having (i) a horizontally disposed flange having a transverse marginal edge and arranged in a common plane with said flange of said main runner, and (ii) an intermediate longitudinal web extending transversely from said flange and having a longitudinal projection extending beyond said transverse marginal edge; (d) said projection adaptable for insertion in one said opening upon said perpendicular arrangement to provide for mating engagement of said longitudinal marginal edge of said main runner with said transverse marginal edge of said cross-runner, thereby supporting said cross-runner and preventing undesired disengagement therebetween, and said flange of said main runner and said flange of said cross-runner being disposed to support tile panels in a common plane.

2. A surface mounted grid system according to claim 1 wherein said side walls include first side walls flanked outwardly on each side by second side walls and spaced therefrom, and said second side walls are provided with said openings.

3. A surface mounted grid system according to claim 2 further including a shoulder extending transversely from opposed sides of said web and spaced below said projection, said shoulder having a transverse marginal edge co-terminus with said transverse marginal edge of said cross-runner, and said transverse marginal edge of said shoulder abuts said second wall upon said perpendicular arrangement.

4. A surface mounted grid system according to claim 1 wherein said spaced, non-peripheral, longitudinal side walls extending transversely from said horizontally oriented surface provide a channel opening, and said downwardly depending member having an intermediate longitudinal web extending transversely from said flange and engageable in said channel and retained therein.

5. A surface mounted grid system according to claim 2 or claim 3 wherein said first side walls extending transversely from said horizontally oriented surface provide a channel opening, and said downwardly depending member having an intermediate longitudinal web extends transversely from said flange and is engageable in said channel and retained therein.

6. A surface mounted grid system according to any one of claim 1, 2 or 3 wherein said horizontally disposed flange of said downwardly depending member has a transverse width, and said horizontally disposed flange of said cross-runner has a transverse width substantially less than the width of said flange of said downwardly depending member.

7. A surface mounted grid system according to any one of claim 1, 2 or 3 wherein said horizontally disposed flange of said downwardly depending member has a transverse width substantially equal with the transverse width of said horizontally disposed flange of said cross-runner.

8. A surface mounted grid system according to any one of claims 1, 2, 3 or 4 wherein said openings of said side walls are in at least two horizontally aligned rows.

9. A surface mounted grid system according to claim 5 wherein said openings of said side walls are in at least two horizontally aligned rows.

10. A surface mounted grid system according to claim 6 wherein said openings of said side walls are in at least two horizontally aligned rows.

* * * * *